US010450825B2

(12) United States Patent
Blekhman et al.

(10) Patent No.: US 10,450,825 B2
(45) Date of Patent: Oct. 22, 2019

(54) TIME OF ARRIVAL-BASED WELL PARTITIONING AND FLOW CONTROL

(71) Applicant: Schlumberger Technology Corporation, Sugar Land, TX (US)

(72) Inventors: Vadim Blekhman, Bellaire, TX (US); Kim Fah Goh, Melaka (MY)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 309 days.

(21) Appl. No.: 15/141,374

(22) Filed: Apr. 28, 2016

(65) Prior Publication Data

US 2016/0319627 A1 Nov. 3, 2016

Related U.S. Application Data

(60) Provisional application No. 62/155,073, filed on Apr. 30, 2015.

(51) Int. Cl.

| | |
|---|---|
| ***E21B 33/12*** | (2006.01) |
| ***E21B 47/10*** | (2012.01) |
| ***E21B 43/14*** | (2006.01) |
| ***E21B 41/00*** | (2006.01) |

(52) U.S. Cl.

CPC ..... *E21B 33/12* (2013.01); *E21B 41/00* (2013.01); *E21B 43/14* (2013.01); *E21B 47/10* (2013.01)

(58) Field of Classification Search

CPC ..... E21B 33/12; E21B 41/00; E21B 47/10; E21B 43/14

USPC ..... 700/283–300

See application file for complete search history.

(56) References Cited

U.S. PATENT DOCUMENTS

| | | | | |
|---|---|---|---|---|
| 8,437,996 | B2 | 5/2013 | Usadi et al. | |
| 8,776,895 | B2 | 7/2014 | Li et al. | |
| 2008/0154505 | A1 | 6/2008 | Kim et al. | |
| 2009/0260415 | A1* | 10/2009 | Suarez-Rivera | G01N 3/46 73/7 |
| 2012/0296619 | A1* | 11/2012 | Maliassov | E21B 43/00 703/10 |
| 2013/0140037 | A1 | 6/2013 | Sequeira, Jr. et al. | |
| 2015/0204174 | A1* | 7/2015 | Kresse | E21B 43/26 166/250.01 |

FOREIGN PATENT DOCUMENTS

WO WO2014032003 A1 2/2014

OTHER PUBLICATIONS

Search Report and Written Opinion of International Application No. PCT/US2016/029936 dated Jul. 26, 2016, 15 pages.

* cited by examiner

*Primary Examiner* — Ziaul Karim

(57) ABSTRACT

A technique includes determining a streamline field in a geologic region that contains a wellbore, based at least in part on a reservoir model of the region. The streamline field includes streamlines that intersect a fluid contact of interest in the region and intersect the wellbore. The technique includes determining arrival times at points along the wellbore associated with the fluid contact boundary of interest based at least in part on fluid travel for the boundary being constrained to occur along the streamlines; and determining partitions associated with isolated completion zones based at least in part on the determined arrival times.

19 Claims, 9 Drawing Sheets

TIME OF ARRIVAL-BASED WELL PARTITIONING AND FLOW CONTROL

CROSS-REFERENCE TO RELATED APPLICATIONS

This application claims the benefit of, and priority to, U.S. Patent Application Ser. No. 62/155,073, filed Apr. 30, 2015, which application is expressly incorporated herein by this reference in its entirety.

BACKGROUND

For purposes of preparing a typical well for the production of oil or gas, completion equipment is installed in the well. The completion equipment may partition segments of the well and the surrounding hydrocarbon reservoir into isolated completion zones. For example, for a given lateral or deviated wellbore of the well, the completion equipment may include a lateral tubing string that is installed to communicate produced well fluid from the wellbore. The tubing string may include sand screens to inhibit sand production; flow control devices to regulate the rate at which well fluid is produced; and packers to form annular seals between the tubular string and the surrounding wellbore to form the isolated zones.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with an example implementation, an article includes a non-transitory computer readable storage medium that stores instructions, which when executed by a computer cause the computer to, based at least in part on a reservoir model of a geologic region containing a wellbore, determine a streamline field in the region. The streamline field includes streamlines that intersect a fluid contact of interest in the region and intersect the wellbore. The instructions when executed by the computer further cause the computer to determine arrival times at points along the wellbore associated with the fluid contact boundary of interest based at least in part on fluid travel for the boundary being constrained to occur along the streamlines; and determine partitions associated with isolated completion zones based at least in part on the determined arrival times.

In accordance with another example implementation, a system includes a memory and a packer advisor engine. The memory stores data that represents streamlines that intersect a fluid of interest in a geologic region and intersect a wellbore in the geologic region. The packer advisor engine includes a processor to determine arrival times at points along a wellbore for a boundary associated with the fluid of interest; constrain fluid travel for the boundary to occur along streamlines; and partition the wellbore into isolated zones based at least in part on the arrival times.

In accordance with yet another example implementation, a technique includes, based at least in part on a reservoir model of a geologic region containing a wellbore, determining a streamline field in the region. The streamline field includes streamlines that intersect a fluid of interest in the region and intersect the wellbore. The technique also includes determining arrival times at points along the wellbore for a boundary associated with the fluid of interest based at least in part on fluid travel for the boundary being constrained to occur along the streamlines; and determining packer placement for a completion installed in the wellbore based at least in part on the arrival times.

Advantages and other features will become apparent from the following drawings, description and claims.

DETAILED DESCRIPTION

In the following description, numerous specific details are set forth but implementations may be practiced without these specific details. Well-known circuits, structures and techniques have not been shown in detail to avoid obscuring an understanding of this description. "An implementation," "example implementation," "various implementations" and the like indicate implementation(s) so described may include particular features, structures, or characteristics, but not every implementation necessarily includes the particular features, structures, or characteristics. Some implementations may have some, all, or none of the features described for other implementations. "First", "second", "third" and the like describe a common object and indicate different instances of like objects are being referred to. Such adjectives do not imply objects so described must be in a given sequence, either temporally, spatially, in ranking, or in any other manner. "Coupled" and "connected" and their derivatives are not synonyms. "Connected" may indicate elements are in direct physical or electrical contact with each other and "coupled" may indicate elements co-operate or interact with each other, but they may or may not be in direct physical or electrical contact. Also, while similar or same numbers may be used to designate same or similar parts in different figures, doing so does not mean all figures including similar or same numbers constitute a single or same implementation.

Figure 1:
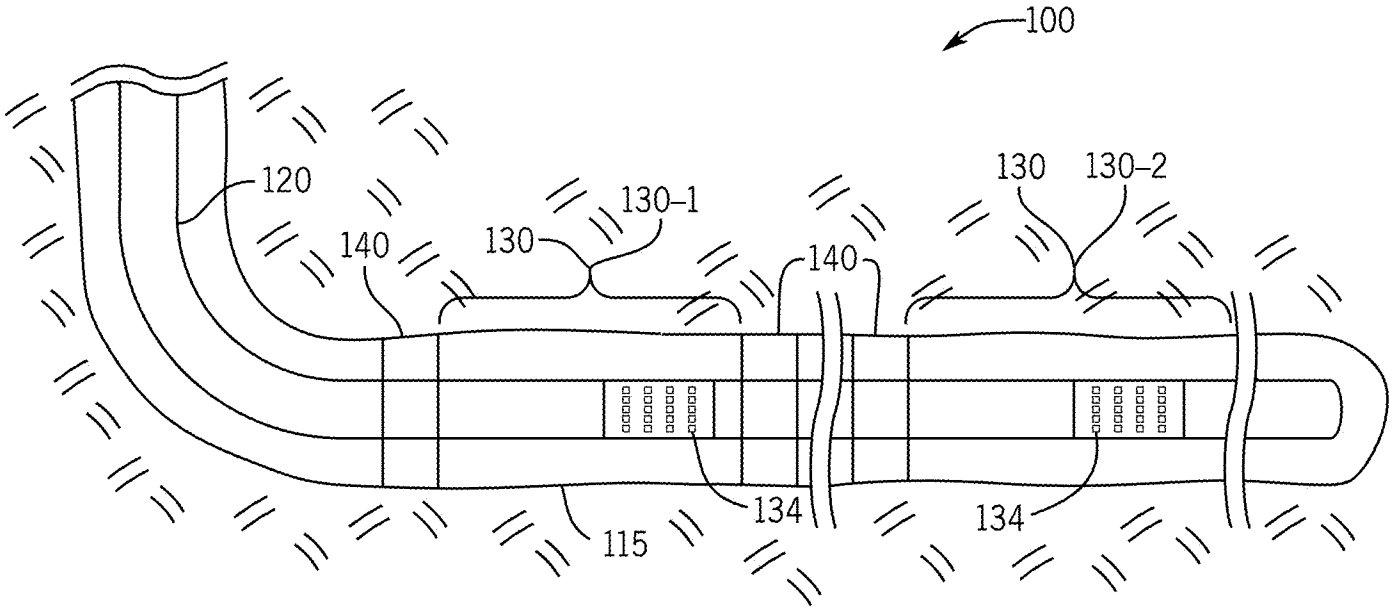
FIG. 1 is a schematic diagram of a lateral wellbore according to an example implementation.

Referring to FIG. 1, in accordance with example implementations, a well 100 may include one or multiple wellbores that extend through a hydrocarbon-bearing geologic structure, such deviated or lateral wellbore 115. Although the wellbore 115 is depicted in FIG. 1 as being uncased, the wellbore 115 may be cased, in accordance with other example implementations. Moreover, the wellbore 115 may be part of a subterranean or subsea well, and may be more vertically-oriented, in accordance with further example implementations.

As depicted in FIG. 1, a tubular completion string 120 extends into the wellbore 115 to form one or more isolated completion zones. In general, the completion string 120 includes packers 140, which partition the wellbore 115 and the hydrocarbon-bearing reservoir in hydraulic communication with the wellbore 115 into isolated completion zones 130 (example completion zones 130-1 and 130-2, being depicted in FIG. 1). As depicted in FIG. 1, a given completion zone 130 may be defined by packers that form the boundaries of the completion zone 130, and each packer 140 radially extends from the completion string 120 to the wellbore wall for purposes of sealing off the annulus to define an isolation boundary. As also depicted in FIG. 1, for each completion zone 130, the completion string 120 may include one or more sand screens 134 (slotted screens or wire-wrapped screens, as examples) for purpose of inhibiting the production of sand. It is noted that although FIG. 1 depicts two completion zones 130-1 and 130-2, the wellbore 115 may have more than two completion zones 130, in accordance with further example implementations.

Although not shown in FIG. 1, the completion string 120 may also contain one or more flow control devices for each completion zone 130 for purposes of regulating the rate at which well fluid flows into the string 120 long the wellbore 115. As examples, the flow control devices may include inflow control devices (ICDs), such as nozzles, which have associated fixed flow areas. The flow control devices may also include inflow control choking controls or flow control valves (FCVs) that have adjustable flow areas.

Techniques and systems are disclosed herein, which use reservoir model-based fluid arrival times for purposes of designing completion segmentation (e.g. determining the number of packers and the corresponding packer positions), as well as sizing inflow equipment (cross-sectional flows of inflow control devices (ICDs), flow areas of flow control valves (FCVs), and so forth) in an extended reach or multiple zone completion for purposes of achieving optimal reservoir sweep efficiency through zonal allocation of the well production rate.

Figure 2:
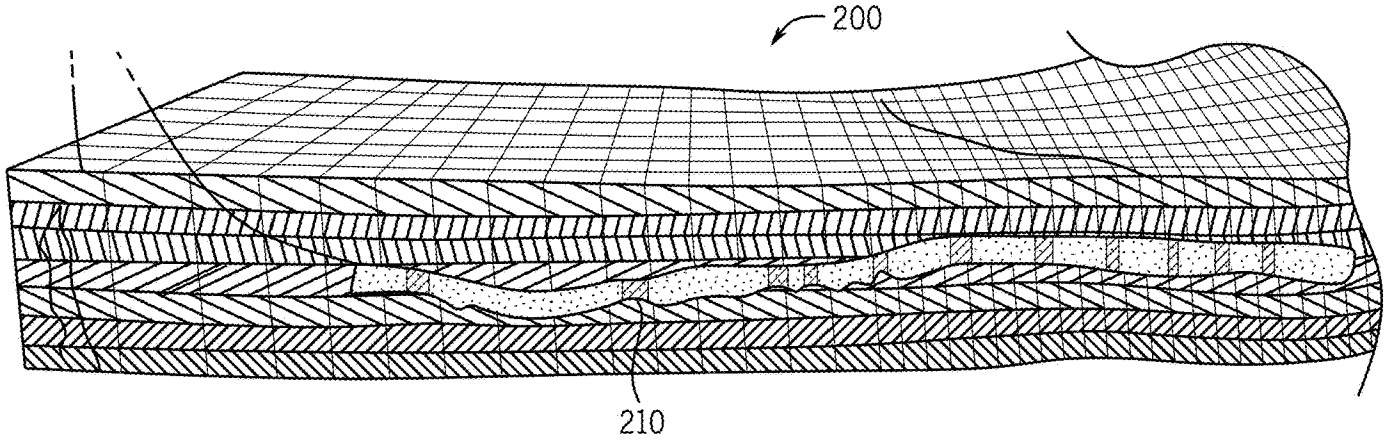
FIG. 2 is an illustration of a reservoir model according to an example implementation.

More specifically, systems and techniques are disclosed herein, which use a reservoir model, such as simplified reservoir model 200 of FIG. 2, to design completion equipment for a wellbore, such as illustrated lateral wellbore 210 that extends through a hydrocarbon-bearing geologic structure. The completion equipment design uses the reservoir model 200 to estimate times (called "times of flight," or "arrival times," herein) for a fluid contact boundary of interest to arrive at different locations along the wellbore 210. In accordance with example implementations, the reservoir model 200 may be a numerical model that is executed on a computer and characterizes the ability of the reservoir to store and produce hydrocarbons. Moreover, as described herein, the reservoir model 200 may be used to construct a pressure distribution, or pressure field, for the reservoir, which, in turn, may be used to estimate, or predict, the arrival times at the wellbore 210 for a fluid contact boundary of interest.

More specifically, in accordance with example implementations, the reservoir model 200 spatially discretizes the reservoir into three dimensional fluid element volumes and may be used to model the inflow of well fluids into the wellbore 210 in discrete time steps (beginning at time zero when fluid through the wellbore 210 begins). As an example, the reservoir model 200 may be based at least in part on one or more of the following: logging-while-drilling (LWD) properties acquired using LWD tools during drilling of the wellbore 210; properties derived from one or more borehole surveys using receivers run into one or more pilot holes and/or one or more offset wells; a field scale reservoir description; knowledge of structural surfaces in the vicinity of the wellbore 210 derived from geo-navigation model used in the placement process of the wellbore 210; properties derived from a wellbore seismic surveys; properties derived from a surface seismic surveys; and so forth.

Figure 3:
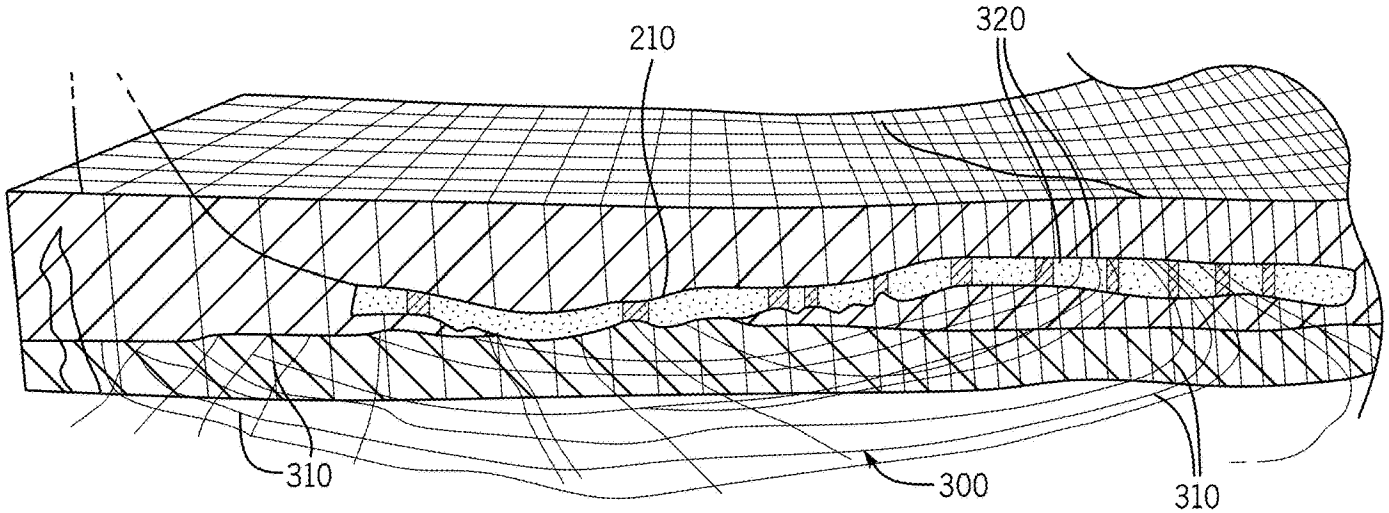
FIG. 3 is an illustration of a reservoir model and an associated streamline field derived from the model according to an example implementation.

Referring to FIG. 3, in accordance with example implementations, the reservoir model 200 is used to construct a streamline field 300 that extends in the reservoir. The streamline field 300 contains streamlines 310, which are the fluid flow pathways for the reservoir, and at least some of the streamlines 310 intersect the wellbore 210. More specifically, in accordance with example implementations, a computer-based fluid flow simulation uses the reservoir model 200 and is run for a relatively few time steps (100 or fewer steps, for example) until an equilibrium flow state is reached and a pseudo-steady state pressure distribution develops. The pressure distribution has constant pressure contour lines along which no flow occurs. In accordance with example implementations, the streamlines 310 are strictly dependent on the reservoir pressure distribution, and each streamline 310 is defined as being orthogonal to the iso-pressure contour at every streamline point. Thus, the streamlines 310 are fully aligned with the direction of fluid flow. An assembly of streamlines 310 (1000 to 10,000, examples) may be generated from the pressure distribution.

Because there is no flow in the direction perpendicular to a given streamline 310, each streamline 310 extends along a no-flow boundary so that the boundary may be traced from a packer location into the reservoir along that streamline 310. Techniques and systems are described herein, which use the streamlines as a basis for flow dependent reservoir partitioning, which allows tracing individual completion zones upstream into the reservoir.

More specifically, in accordance with example implementations, each streamline 310 arrives at an associated position 320 of the wellbore 210. It is noted that a given wellbore position 320 may be associated with a group, or bundle, of multiple streamlines 310. A certain time exists for a fluid contact boundary of interest (a water/oil boundary, for example) to travel from the reservoir to a particular wellbore position 320 along an associated streamline 310. Thus, for a given streamline 310 that intersects the wellbore 210, every elemental fluid volume along that line may be assigned a unique time for that elemental fluid volume to flow into the wellbore sink. In accordance with example implementations, a single arrival time is assigned to each of the streamlines 310 intersecting the wellbore 210 based on the point where the streamline 310 pierces through the fluid contact boundary of interest, and these arrival times may then be used to partition the wellbore 210 and reservoir, and determine flow equipment parameters, as further described herein.

Figure 4:
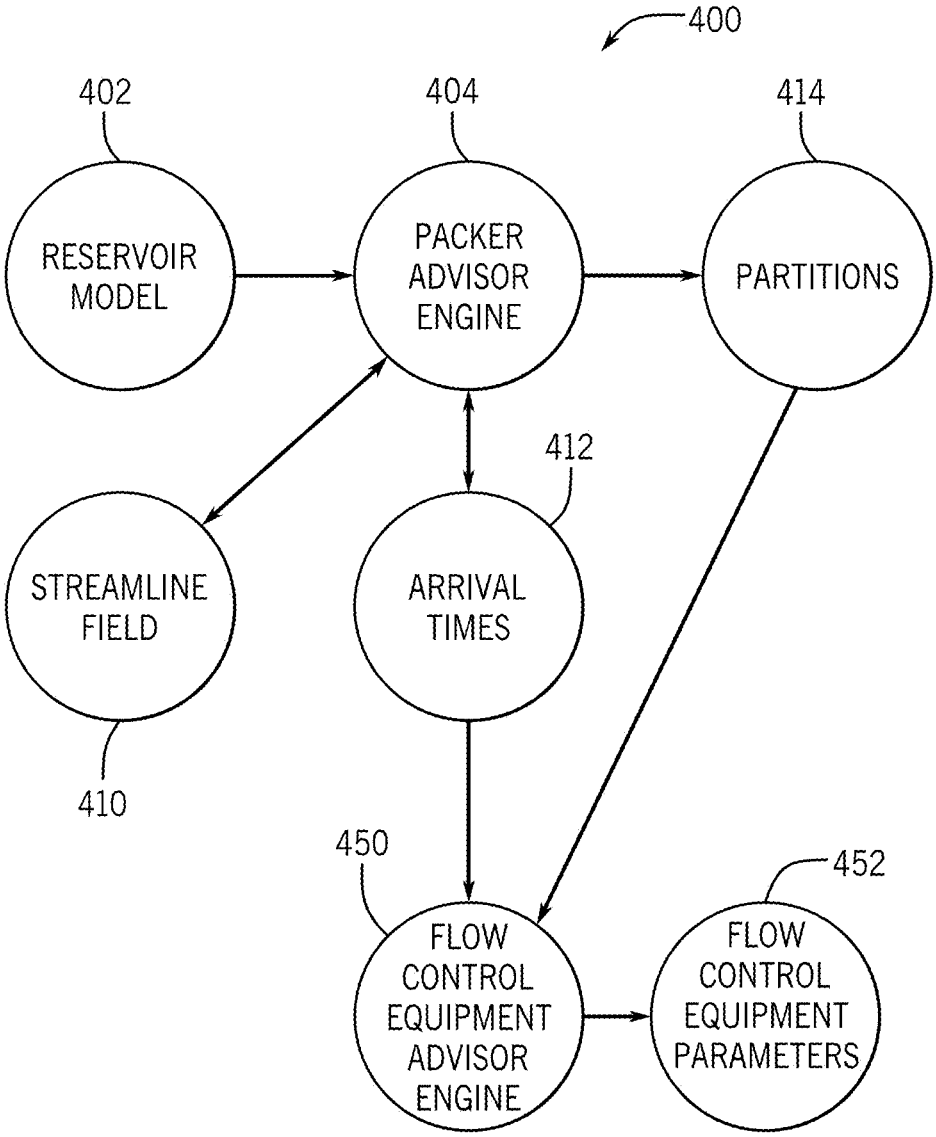
FIG. 4 is a schematic diagram of a system to determine partitions for a wellbore and reservoir, and determine parameters for flow control equipment according to an example implementation.

FIG. 4 depicts an example computer-based system 400 that is constructed to use fluid arrival time-based techniques to design a completion system for a given wellbore. In accordance with example implementations, the system 400 includes a packer advisor engine 404 that may be used as an analytic tool for a human completion designer to determine partitions 414 for a given wellbore and a reservoir. In this manner, the packer advisor engine 404 is constructed to provide computer-aided analysis to aid in determination of the number of packers to be installed in the wellbore and the placement of these packers. The system 400 may also include a flow control equipment advisor engine 450, in accordance with example implementations, which serves an analytic tool for a human designer for purposes of determining flow control equipment parameters 452 (the number of inflow control devices (ICDs) per zone, ICD flow path areas and so forth) for the wellbore completion.

The packer advisor engine 404 uses a reservoir model 402 to determine a streamline field 410. In this manner, in accordance with example implementations, the packer advisor engine 404 advances the reservoir model 402 through a limited number of time steps until an equilibrium flow state is reached and a pseudo-steady state pressure distribution develops. For this state of the reservoir model 402, the packer advisor engine 404 constructs streamlines that are orthogonal to the iso-pressure contours and uses these streamlines to, for each streamline that intersects the wellbore, determine an associated arrival time 412. More specifically, a fluid boundary contact of interest is first identified for the packer advisor engine 404, such as, for example, by a user inputting data into the engine 404 that identifies the fluid contact boundary of interest or the user otherwise informing the engine 404 (e.g., via a graphical user interface (GUI) about the fluid boundary contact of interest. As an example, the fluid boundary contact of interest may be an oil-water boundary.

Using the identified fluid contact boundary of interest, the packer advisor engine 404 identifies the streamlines that interest the wellbore and the fluid boundary contact of interest, and for each identified streamline, the packer advisor engine 404 identifies a corresponding fluid element for the streamline where the streamline intersects the boundary of interest. The packer advisor engine 404 may then determine a time (i.e., an "arrival time") for the fluid element to travel along the streamline to the wellbore.

Thus, the packer advisor engine 404 uses a streamline approach to reservoir flow modeling. For a given time step, there is no cross-flow between streamline bundles flowing into the neighboring completion compartments. If the rate is kept unchanged for a given completion through several simulation time steps, there is relatively little change occurring in the streamline geometry over that time because the underlying pressure field is not changing substantially across the reservoir.

In accordance with example implementations, the packer advisor engine 404 applies a clustering algorithm that partitions the wellbore based on local variances of the arrival times (within the determined partition windows) or at least determines a partitioning that reduces the local variances below an acceptable threshold. As a result of the clustering, the packer advisor engine 404, in accordance with example implementations, identifies a number of packers to be installed in the wellbore and the placement of the packers.

It is noted that, in general, local variances in the arrival times may, in general, be reduced with an increasing number of packers. However, the relative variance reduction may significantly taper off as the number of packers reaches a threshold, and increasing the number of packers above this threshold may have limited to no additional benefit. To guide the partitioning, in accordance with example implementations, the packer advisor engine 404 displays a representation of a partitioning quality versus the number of partitions so that the user may decide a point at which increased partitioning has diminished returns. In accordance with example implementations, the packer advisor engine 404 may determine the partitioning quality by applying an inverse function to the variance.

Figure 5A:
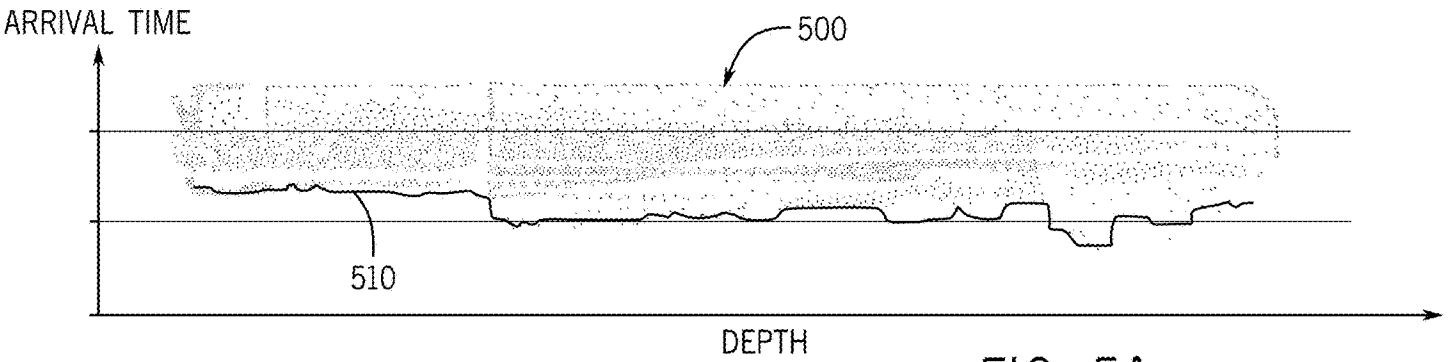
FIG. 5A is a log depicting arrival times for a fluid contact boundary of interest versus depth according to an example implementation.
Figure 5B:
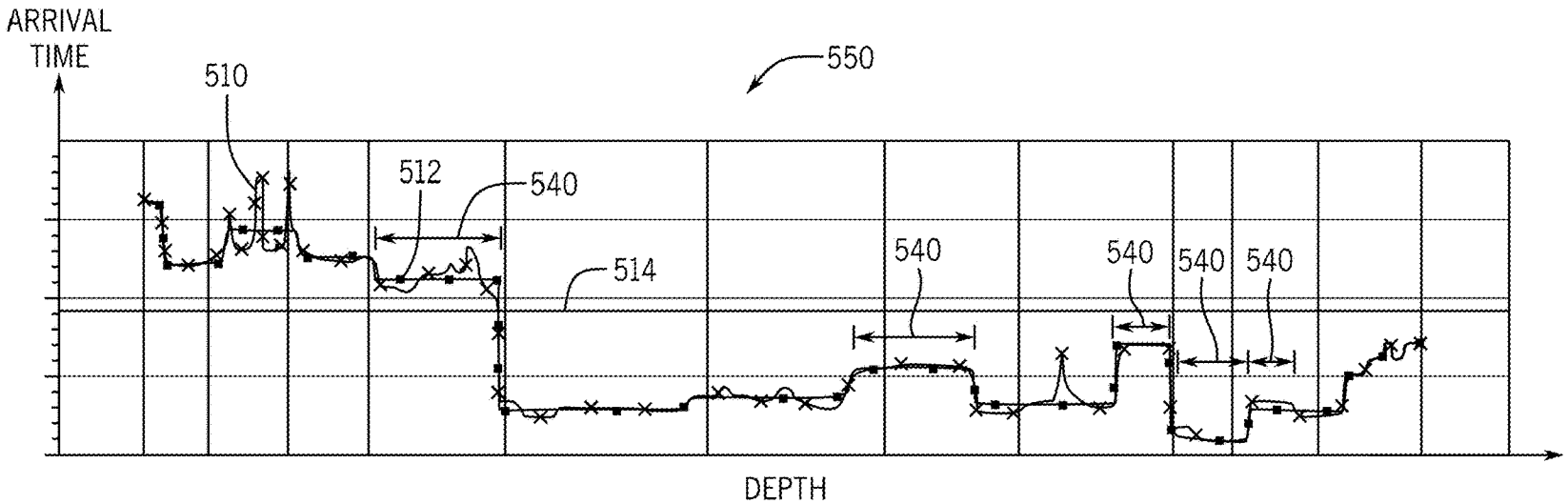
FIG. 5B is a log of the shortest arrival time of FIG. 5A versus depth illustrating a partitioning technique according to an example implementation.

FIGS. 5A and 5B depict example logs illustrating how the packer advisor engine 404 performs the partitioning, in accordance with an example implementation. Referring to FIG. 5A in conjunction with FIG. 4, the packer advisor engine 404 determines a log 500 of the arrival times versus depth (i.e., axial position) long the wellbore. As illustrated in FIG. 5A, each depth is associated with multiple arrival times, which correspond to the arrival times for streamlines of an associated streamline bundle intersecting the wellbore at that depth. As also shown in FIG. 5A, in accordance with example implementations, the packer advisor engine 404 uses the shortest arrival times, which belong to profile 510, to predict, or forecast, the time for breakthrough of the fluid contact boundary of interest. As illustrated in FIG. 5A, the forecasted breakthrough time varies with depth.

Referring to FIG. 5B in conjunction with FIG. 4, in accordance with example implementations, the packer advisor engine 404 applies a variance-based clustering algorithm to the shortest arrival time profile 510 for purposes of dividing the profile 510 into windows, which correspond to partitions. In particular, FIG. 5B depicts an example iteration of the clustering algorithm in which the partitions are denoted by a window function 512, which may be viewed as a step function that transitions abruptly from one average arrival time value to the next. Each average arrival time value corresponds to a partition window. In this manner, FIG. 5B depicts partition windows 540 of the profile 510, and within each window, the window function 512 has a value equal to the average of the arrival times within the window. The packer advisor engine's clustering algorithm determines the local variance of the arrival time within each window with the goal to perform a clustering that minimizes or at least reduces the local variances below a given threshold so that the arrival times for each window are close to the average arrival time for that window.

In accordance with example implementations, the clustering algorithm clusters the arrival times in a number of iterations, with each iteration producing a predefined number of clusters based on the variance of the arrival times. In accordance with example implementations, a given clustering iteration may contain an initial pass in which one or more partition locations (i.e., the boundaries of the partition window) correspond to wellbore locations that are unsuitable for setting a packer due the local wellbore conditions. The packer advisor engine 404, in accordance with example implementations, adjusts the partition locations that were identified in the initial pass to ensure that the partition locations correspond to suitable locations for setting packers.

In this manner, in accordance with example implementations, the packer advisor engine 404 consults data representing wellbore conditions to check whether one or more partition locations that were identified by the clustering algorithm are suitable for packer placement. As an example, the packer advisor engine 404 may check the resulting packer locations against such wellbore conditions, as washout (caliper) and shale content to ensure that the respective packers could be set properly. In accordance with example implementations, the packer advisor engine 404 may adjust the packer locations in relatively small increments until suitable packer locations that correspond to the number of packer locations identified by the clustering are determined.

Figure 6:
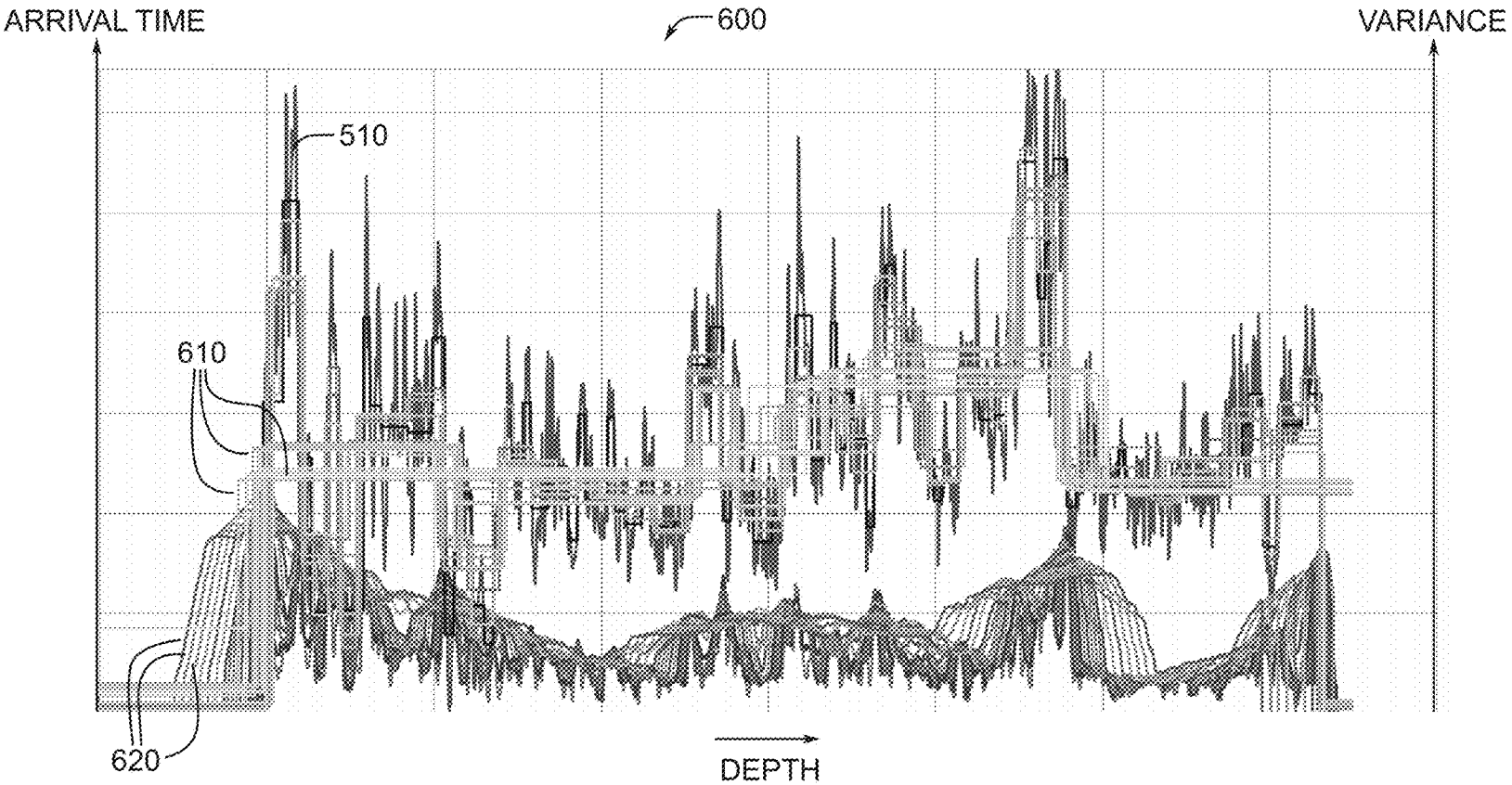
FIG. 6 depicts arrival time and variance versus depth according to an example implementation.
Figure 7:
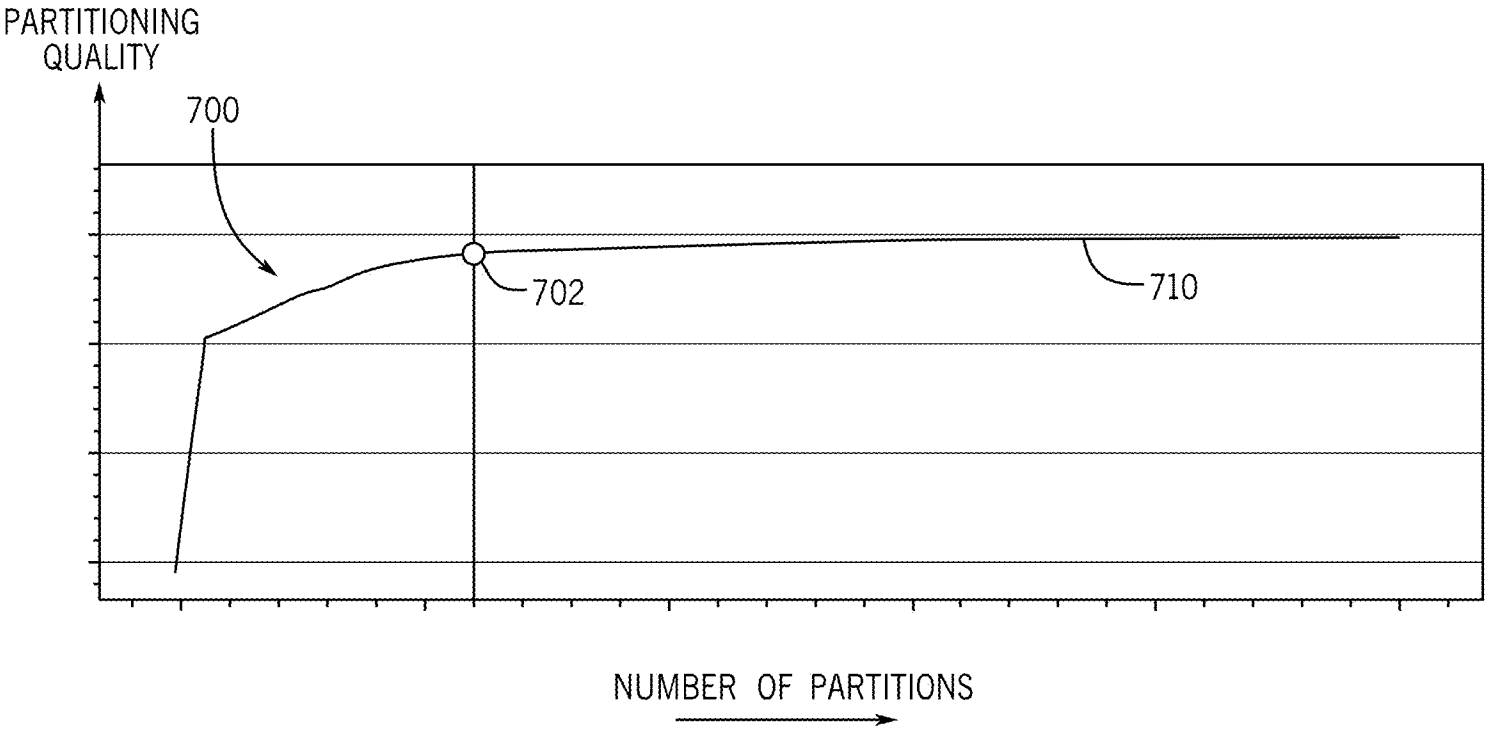
FIG. 7 is a graph of partitioning quality versus a partition number according to an example implementation.

As an example, FIG. 6 depicts an illustration 600 of variances 620 that are associated with different partitioning window functions 610 that are associated with different partition numbers (and clustering iterations). The packer advisor engine 404, in accordance with example implementations, may, based on an inverse measure of the variances associated with these iterations, display a partitioning quality versus partition number based, such as a partitioning quality that is depicted in FIG. 7. Referring to FIG. 7, for this example, the partitioning quality 700 increases from zero packers and eventually flattens out with the number of partitions, as illustrated at reference 710. As also depicted at reference numeral 702 in FIG. 7, there may be a given number of partitions beyond which the effect of further partitioning is diminished.

Figure 8:
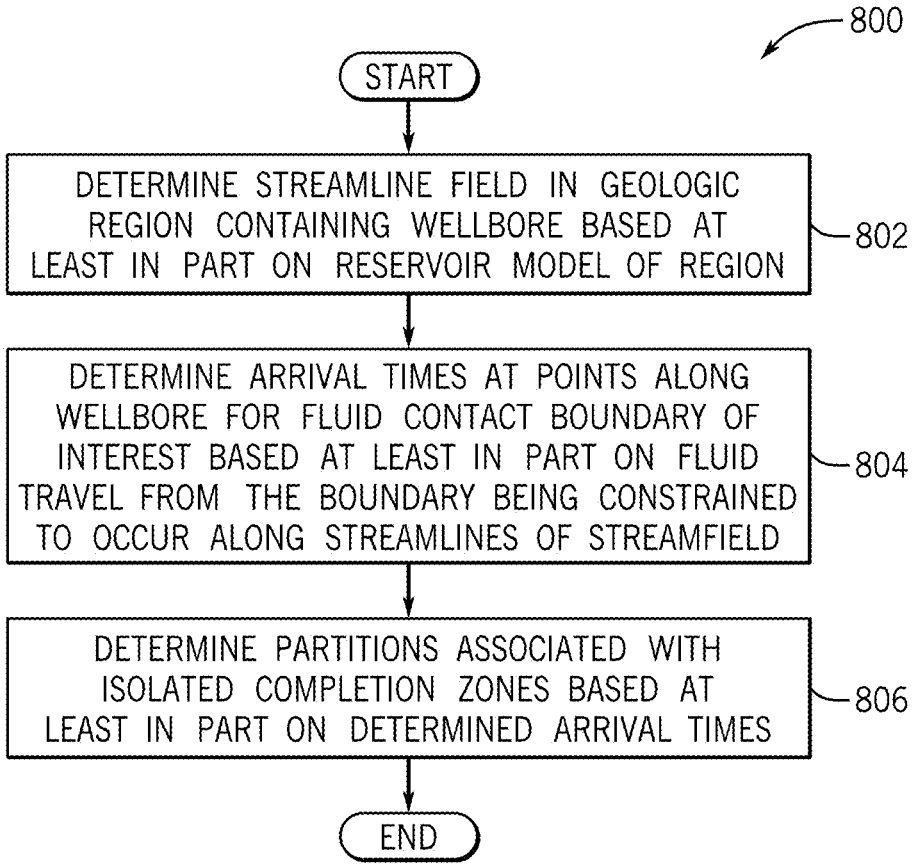
FIGS. 8 and 9 are flow diagrams depicting techniques to determine partitions associated with isolated completion zones according to example implementations.

Thus, referring to FIG. 8, in accordance with example implementations, a technique 800 includes determining (block 802) a streamline field in a geologic region that contains a wellbore based at least in part on a reservoir model of the region. Pursuant to the technique 800, arrival times are determined (block 804) at points along the wellbore for a fluid contact boundary of interest based at least in part on fluid travel from the boundary being constrained to occur along the streamlines of the streamline field. Partitions that are associated with isolated completion zones may then be determined based at least in part on the determined arrival times, pursuant to block 806.

Figure 9:
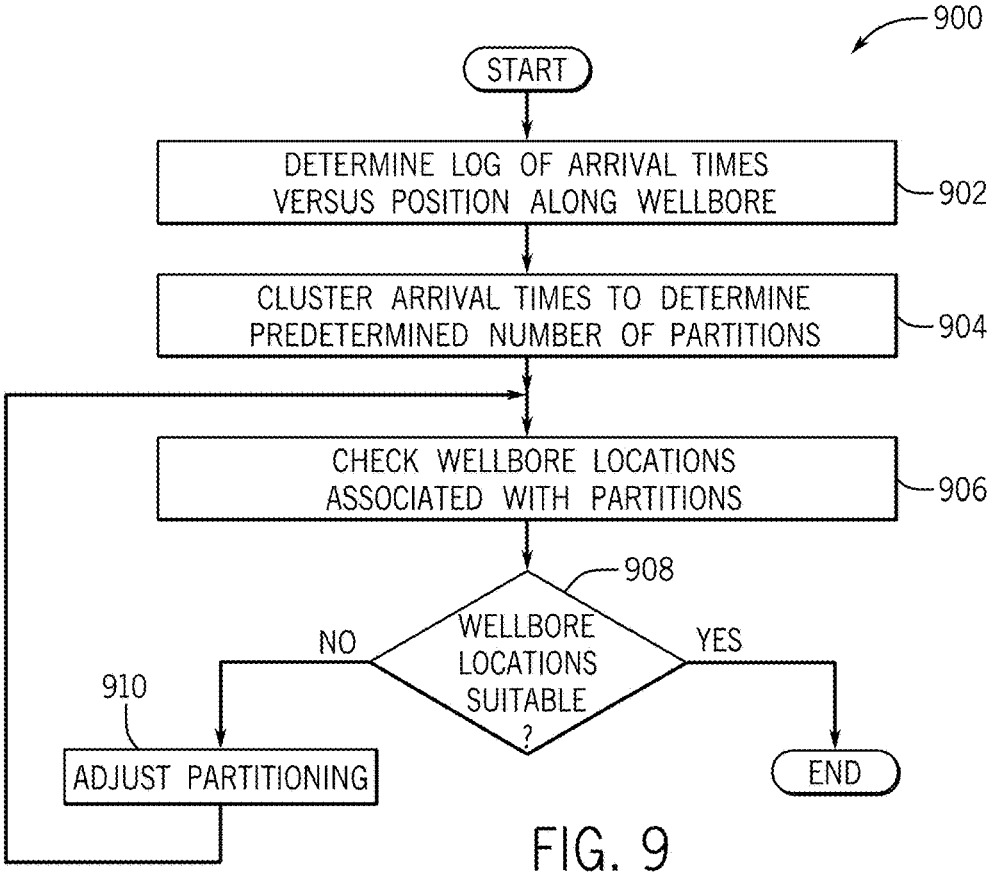

More specifically, in accordance with example implementations, a technique 900 (FIG. 9) may be used to determine a predetermined number of partitions. The technique 900 includes determining (block 902) a log of arrival times versus position along a wellbore and clustering (block 904) the arrival times to determine the predetermined number of partitions. Pursuant to the technique 900, the wellbore locations that are correspond to the partitions are checked (block 906) to determine (decision block 908) whether the locations are suitable for packer placement. If not, then the partitioning is adjusted (block 910) and the adjusted locations are checked again, pursuant to block 906 for purposes of determining whether additional adjustment is needed. If the wellbore locations are suitable for packer placement, then the partitioning determination for the predetermined number of partitions is complete. It is noted that the technique 900 may be performed for other partition numbers, and moreover, the packer advisor engine 404 may determine a partitioning quality for partition number.

Referring back to FIG. 4, in accordance with example implementations, similar to the packer advisor engine 404, the flow control equipment advisor 450 also uses a streamline-based approach to the reservoir flow modeling. Assuming that the average arrival times from fluid contacts to the completion can be equalized between all of the completion compartments through sizing of respective inflow control device (ICD) nozzles, the overall variance curve (such as the curve of FIG. 5B) represents a direct measure of the overall reservoir sweep efficiency, which is the most logical completion level objective function for a typical ICD design.

In accordance with example implementations, the flow control equipment advisor 450 equalizes average arrival times from fluid contacts for different streamline bundles that are associated with a particular partition. If the required timing to a conformant break through along the entire completion is represented by "T," then, in general, the flow control equipment advisor 45 modifies the individual compartment rate (called "Qi") as follows:

$$Qi_{NEW} = \frac{T}{T_{ARRIVAL}i} \cdot Qi, \qquad \text{Eq. 1}$$

where "$Qi_{NEW}$" represents the new calculated flow rate for the partition; and "$T_{ARRIVAL}i$" represents the average arrival time for partition i. In accordance with example implementations, if the $T_{ARRIVAL}i$ time is greater than T for a given partition, then the flow control equipment advisor relaxes the constraint imposed by Eq. 1 for that compartment because the rate for that partition cannot be significantly increased above the fully open rate through additional choking of the neighboring partitions. Depending on the particular implementation, the flow control equipment advisor 450 may display calculated flow control equipment parameters, such as the calculated flow rates for the partitions.

Figure 10:
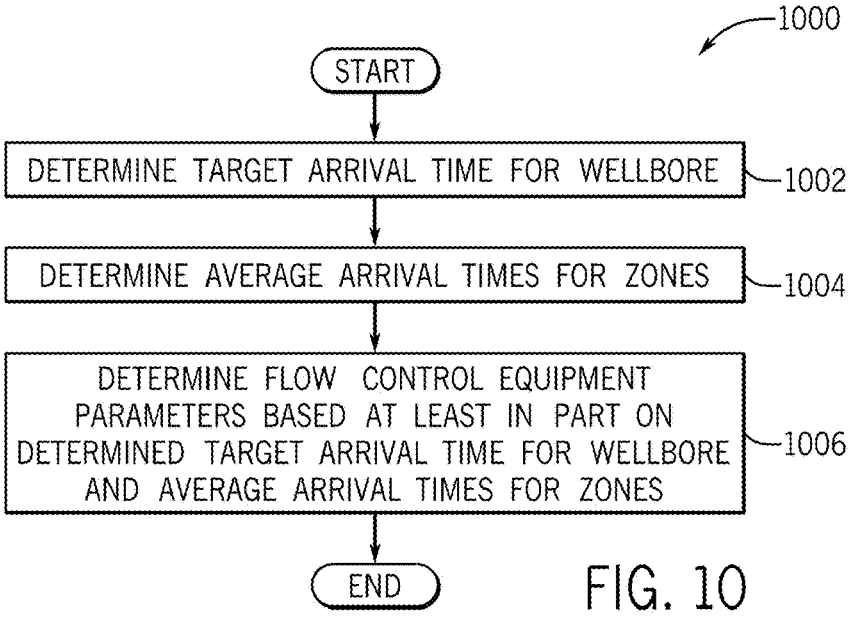
FIG. 10 is a flow diagram depicting a technique to determine flow control equipment parameters according to an example implementation.

Thus, referring to FIG. 10, in accordance with example implementations, a technique 1000 includes determining (block 1002) a target arrival time for a wellbore and determining (block 1004) average arrival times for partitions. Pursuant to the technique 1000, flow control equipment parameters may then be determined based at least in part on the determined target arrival time for the wellbore and average arrival times for the zones, pursuant to block 1006.

Figure 11:
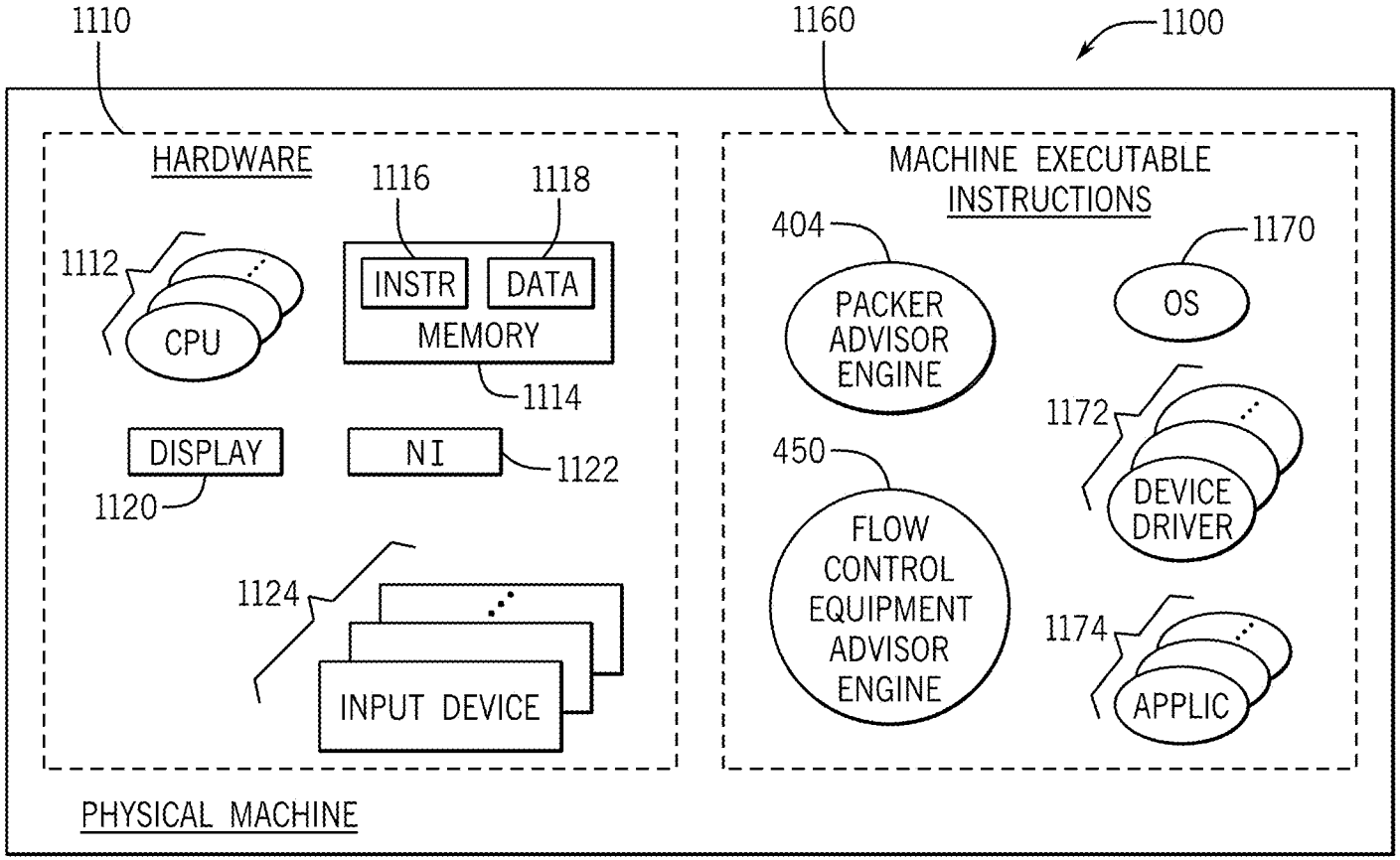
FIG. 11 is a schematic diagram of a physical machine according to an example implementation.

In accordance with example implementations, the system 400 of FIG. 4 may include at least one physical machine, such as example physical machine 1100 that is depicted in FIG. 11. Referring to FIG. 11, the physical machine 1100 is an actual machine that is made up of actual hardware 1110 and actual machine executable instructions 1160, or "software."

The hardware 1110 may include, for example, one or multiple central processing units (CPUs) 1112 and a memory 1114. In general, the memory 1114 is a non-transitory storage medium that may store data 1118, program instructions 1116, data structures, and so forth, depending on the particular implementation. The memory 1114 may be formed from non-transitory storage devices, such as one or more of the following: semiconductor storage devices, phase change memory devices, magnetic storage devices, optical storage devices, memristors, and so forth. In accordance with example implementations, the instructions 1116 may include instructions that when executed by the CPU(s) 1112 cause the CPU(s) to form the packer advisor engine 404 and the flow control equipment advisor engine 450. In accordance with example implementations, the CPU(s) 1112 may execute the instructions 1116 to form all or part of any of the techniques that are disclosed herein, such as techniques 800, 900, 1000 and 1200 (discussed below).

The data 1118 may include data representing arrival times, variances, a reservoir model parameter, a streamline flow field, partitioning parameters, flow control parameters, arrival time averages, average flow wellbore flow rate, and so forth. The physical machine 1100 may include other hardware 1110 and machine executable instructions 1160. In this regard, the physical machine 1100 may include such additional hardware 1110 as a network interface 1120, input devices 1124 (a keyboard, a mouse, and so forth) and a display 1120. Moreover, the machine executable instructions 1160 may form other software entities, such as an operating system 1170, applications 1174, device drivers 1172, and so forth.

Other implementations are contemplated which are within the scope of the appended claims. For example, in accordance with further example implementations, although FIG. 11 depicts a single physical machine 1100, the systems and techniques that are disclosed herein may be performed on multiple physical machines and/or a distributed computer architecture in which physical machines are disposed at different physical locations. Moreover, the packer advisor engine 404 and/or flow control equipment parameter advisor 450 may be provided by one or more virtual machines that execute on one or more physical platforms.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. An article comprising a non-transitory computer readable storage medium storing instructions that when executed by a computer cause the computer to:

based at least in part on a reservoir model of a geologic region containing a wellbore, determine a streamline field in the region, the streamline field comprising streamlines that intersect a fluid contact boundary of interest in the region and intersect the wellbore;

determine arrival times at points along the wellbore associated with the fluid contact boundary of interest based at least in part on fluid travel for the boundary being constrained to occur along the streamlines; and determine partitions associated with isolated completion zones based at least in part on variances of the determined arrival times, the partitions reducing the variances below an acceptable threshold, wherein determining the streamline field in the region, determining the arrival times, and determining the partitions facilitate completion system design for the wellbore, the storage medium storing instructions that when executed by the computer cause the computer further to:

determine a log of the arrival times versus position along the wellbore;

partition the log into windows, wherein each window is associated with a set of the arrival times and a window-based average of arrival times;

for each window, determining the variance based on the associated set of arrival times and an average arrival time; and control the partitioning based at least in part on the determined variance.

2. The article of claim 1, wherein the partitions comprise partitions of the wellbore and the reservoir.

3. The article of claim 1, the storage medium storing instructions that when executed by the computer cause the computer to determine the partitions for a first number of partitions, determine the partitions for a second number partitions and indicate partitioning qualities associated with the first and second numbers.

4. The article of claim 1, the storage medium storing instructions that when executed by the computer cause the computer to determine a log of a first plurality of arrival times associated with the fluid contact as a function of position along the wellbore, wherein a given position along the wellbore is associated with multiple arrival times of the first plurality of arrival times; and select the arrival times of the first plurality of arrival times corresponding to a minimum arrival time associated with a breakthrough for each position to determine the arrival times used in the determination of the partitions.

5. The article of claim 1, the storage medium storing instructions that when executed by the computer cause the computer to apply variance-based clustering of the arrival times to determine the partitions.

6. The article of claim 5, wherein the acceptable threshold is a predetermined minimization threshold, and wherein the storage medium stores instructions that when executed by the computer cause the computer to perform the clustering by identifying boundaries between segments of the wellbore for which a variance of the arrival times about the corresponding averages of segment arrival times is below the predetermined minimization threshold.

7. The article of claim 5, the storage medium storing instructions that when executed by the computer cause the computer to:

cluster the arrival times to partition the wellbore into segments; and create an output representing a partitioning quality for the first number of segments based on variance.

8. The article of claim 1, the storage medium storing instructions that when executed by the computer cause the computer to further base the partitioning at least in part on a suitability of the wellbore for setting a packer at a given location of the wellbore.

9. The article of claim 1, the storage medium storing instructions that when executed by the computer cause the computer to:

determine an average arrival time for at least one of the isolated zones; and determine a nozzle size for the at least one isolated zone based at least in part on the determined average arrival time.

10. The article of claim 1, the storage medium storing instructions that when executed by the computer cause the computer to:

provide a target arrival time for the wellbore based on a given well flow rate and a hydrocarbon pore volume in a wellbore drainage area; and further base determination of the nozzle size on the target arrival time for the wellbore.

11. The article of claim 10, the storage medium storing instructions that when executed by the computer cause the computer to perform control inflow control device nozzles or inflow control choking areas to redistribute individual partition rates such that resulting arrival times are transformed from initially calculated arrival time averages for each of the partitions to the target arrival for the wellbore.

12. A system comprising:

a memory storing data representing streamlines that intersect a fluid of interest in a geologic region and intersect a wellbore in the geologic region; and a packer advisor engine comprising a processor to:

determine arrival times at points along a wellbore for a boundary associated with the fluid of interest;

constrain fluid travel for the boundary to occur along streamlines; and partition the wellbore into isolated zones based at least in part on the arrival times, wherein the packer advisor engine is adapted to partition the wellbore by clustering the arrival times based at least in part on a variance of the arrival times, the partitioning reducing the variance below an acceptable threshold, and wherein processing executed by the packer advisor engine facilitates completion system design for the wellbore, the processor of the packer advisor engine further executing processing to:

determine a log of the arrival times versus position along the wellbore;

partition the log into windows, wherein each window is associated with a set of the arrival times, a constructed arrival time and a different segment of the wellbore;

for each window, determine variances based on the associated set of arrival times and constructed arrival time; and control the partitioning based at least in part on the determined variances.

13. The system of claim 12, wherein the streamlines are orthogonal to isopressure contours described by a reservoir model of the geologic region.

14. The system of claim 12, further comprising:

a nozzle size advisor engine adapted to determine a nozzle size for the at least one isolated zone based at least in part on the determined average arrival time.

15. A method comprising:

based at least in part on a reservoir model of a geologic region containing a wellbore, determining a streamline field in the region, the streamline field comprising streamlines that intersect a fluid of interest in the region and intersect the wellbore;

determining arrival times at points along the wellbore for a boundary associated with the fluid of interest based at least in part on fluid travel for the boundary being constrained to occur along the streamlines, wherein determining the arrival times comprises:

determining a log of a first plurality of arrival times for the boundary as a function of position along the wellbore, wherein a given position along the wellbore is associated with multiple arrival times of the first plurality of arrival times; and determining packer placement for a completion installed in the wellbore based at least in part on variances of the arrival times, the packer placement reducing the variances below an acceptable threshold, wherein determining packer placement comprises:

clustering the arrival times to partition the wellbore into a first number of segments;

determining a variance of the arrival times for each segment for the number of segments;

repeating performing the clustering and determining the variance for a second number of segments greater than the first number of segments; and determining a partitioning quality for the first number of segments and the second number of segments; and controlling the packer placement based at least in part on the determined partitioning quality, wherein the steps of determining the streamline field in the region, determining arrival times, and determining packer placement for the completion installed in the wellbore facilitate completion system design for the wellbore.

16. The method of claim 15, wherein determining the arrival times further comprises:

selecting the arrival times of the first plurality of arrival times corresponding to a maximum arrival time for each position to determine the arrival times used in the determination of the packer placement.

17. The method of claim 15, further comprising:

determining an average arrival time for at least one of the isolated zones; and determining a nozzle size for the at least one isolated zone based at least in part on the determined average arrival time.

18. The method of claim 15, further comprising:

determining an arrival time for the wellbore; and further basing determination of the nozzle size on the arrival time for the wellbore.

19. The method of claim 15, further comprising placing packers to isolate a zone of the completion based on the determining packer placement step.

* * * * *